US005782614A

United States Patent [19]

Shimizu et al.

[11] Patent Number: 5,782,614

[45] Date of Patent: Jul. 21, 1998

[54] RECIPROCATING COMPRESSOR IN WHICH GAS IS SUPPLIED TO EACH OF OPPOSITE ENDS OF A SUCTION CHAMBER EXTENDING AROUND A DISCHARGE CHAMBER ON A PLANE

[75] Inventors: Shigemi Shimizu, Sawa-gun; Yujiro Morita, Honjo, both of Japan

[73] Assignee: Sanden Corporation, Gunma, Japan

[21] Appl. No.: 832,854

[22] Filed: Apr. 4, 1997

[30] Foreign Application Priority Data

Apr. 5, 1996 [JP] Japan ..... 8-083470

[51] Int. Cl.[6] ..... F04B 1/12

[52] U.S. Cl. ..... 417/269; 417/312; 417/540; 181/403

[58] Field of Search ..... 417/312, 269, 417/540; 181/403

[56] References Cited

U.S. PATENT DOCUMENTS

| | | | |
|---|---|---|---|
| 4,813,852 | 3/1989 | Ikeda et al. | 417/312 |
| 4,820,133 | 4/1989 | Steele et al. | 417/269 |
| 5,051,069 | 9/1991 | Okeda et al. | 417/269 |
| 5,236,312 | 8/1993 | Finn et al. | 417/312 |
| 5,533,871 | 7/1996 | Takenaka et al. | 417/269 |
| 5,645,405 | 7/1997 | Ota et al. | 417/312 |

FOREIGN PATENT DOCUMENTS

| | | |
|---|---|---|
| 4515088 | 11/1994 | Germany . |
| 4342299 | 1/1995 | Germany . |
| 4446302 | 6/1995 | Germany . |

OTHER PUBLICATIONS

European Search Report, completed Jun. 16, 1997, The Hague.

*Primary Examiner*—Timothy Thorpe
*Assistant Examiner*—Peter G. Korytnyk
*Attorney, Agent, or Firm*—Baker & Botts, L.L.P.

[57] ABSTRACT

In a reciprocating compressor in which a suction chamber (7) extends around a discharge chamber (6) parallel to suction, a discharge gas conducting passage (6c) is connected to the discharge chamber and is adjacent to a suction gas inlet passage (7a) in a predetermined direction orthogonal to the plane. The suction gas inlet passage communicates with each of the first and second opposite ends of the suction chamber so that gas is supplied into the suction chamber through each of the first and second opposite ends thereof. A plurality of compression elements are arranged along the suction chamber and connected to the discharge chamber and the suction chamber. Each of the compression elements have a piston (16) which reciprocates to introduce the gas from the suction chamber, to compress the gas, and then to discharge the gas into the discharge chamber.

10 Claims, 5 Drawing Sheets

RECIPROCATING COMPRESSOR IN WHICH GAS IS SUPPLIED TO EACH OF OPPOSITE ENDS OF A SUCTION CHAMBER EXTENDING AROUND A DISCHARGE CHAMBER ON A PLANE

BACKGROUND OF THE INVENTION

The present invention relates to a compressor mainly for use in a vehicle air conditioner, and more specifically, to a reciprocating compressor including a plurality of compression elements.

The reciprocating compressor of one type includes a cylinder block formed therein with a plurality of circumferentially arranged bores, a housing formed therein with a crank chamber and closing the front end of the cylinder block, a drive shaft rotatably supported by the cylinder block and the housing, a swash-plate element mounted on the drive shaft, single-head pistons each of which reciprocates within the corresponding bore in response to movement of the swash-plate element, a cylinder head attached to the cylinder block at the rear end thereof via a valve plate interposed therebetween and formed with a discharge chamber at the center thereof and a suction chamber at the peripheral region thereof surrounding the discharge chamber, and a pressure suppressing chamber communicating with the discharge chamber for receiving discharge gas from the discharge chamber. In such a compressor, for introducing the discharge gas from the centrally positioned discharge chamber into the pressure suppressing chamber, it is arranged that the peripherally positioned suction chamber is divided by a discharge gas conducting passage or reduced in height at a portion thereof in an axial direction of the drive shaft so as to form a discharge gas conducting passage at such a portion.

However, when the suction chamber is divided by the discharge gas conducting passage, since suction gas is introduced into the suction chamber at one end thereof and flows a long way through the suction chamber, the amounts of suction gas become nonuniform at the respective bores to thereby cause lowering of the refrigerating capacity due to deterioration of the volumetric efficiency and the vibration and noise due to suction pulsation. On the other hand, when the portion of the suction chamber is reduced in height, a suction passage at that portion is narrowed to thereby cause lowering of the refrigerating capacity due to deterioration of the volumetric efficiency.

For solving such a problem, it has been proposed, for example, in Japanese First (unexamined) Patent Publication No. 7-139463 or Japanese First Utility Model Publication No. 61-145884 that a suction passage is provided striding over the centrally positioned discharge chamber so as to introduce suction gas into the peripherally positioned suction chamber, or the wall defining the centrally positioned discharge chamber is wholly increased in axial height so as to enlarge the narrowed portion of the suction chamber.

However, in the former arrangement, since the suction passage strides over the discharge chamber, the compressor is increased in axial length, which should be avoided in view of a limited mounting space for the compressor. Further, the complicated structure is resulted by the provision of the suction passage and communication holes which are required between the suction passage and the suction chamber. Similarly, in the latter arrangement, since the wall of the discharge chamber is increased in axial height, the compressor is increased in axial length.

SUMMARY OF THE INVENTION

It is therefore an object of the present invention to provide an improved reciprocating compressor in which gas is supplied to each of opposite ends of a suction chamber extending around a discharge chamber on a plane.

Other objects of this invention will become clear as the description proceeds.

According to one aspect of the present invention, there is provided a reciprocating compressor comprising a discharge chamber on a plane, a suction chamber extending around the discharge chamber on the plane to have opposite ends, a suction gas inlet passage connected the suction chamber for introducing gas into the suction chamber, and a plurality of compression elements arranged along the suction chamber and connected to the discharge chamber and the suction chamber. Each of the compression elements has a piston which reciprocates to introduce the gas from the suction chamber, to compress the gas, and then to discharge the gas into the discharge chamber. The reciprocating compressor further comprises a discharge gas conducting passage connected to the discharge chamber for conducting the gas from the discharge chamber. In the reciprocating compressor, the discharge gas conducting passage is adjacent to the suction gas inlet passage in a predetermined direction orthogonal to the plane. The suction gas inlet passage communicates with each of the opposite ends of the suction chamber so that the gas is supplied into the suction chamber through each of the opposite ends thereof.

According to another aspect of the present invention, there is provided a reciprocating compressor comprising a cylinder block having a plurality of bores arranged in parallel, a housing having therein a crank chamber and closing one end of the cylinder block, a drive shaft rotatably supported by the cylinder block and the housing, a swash-plate element mounted on the drive shaft, pistons reciprocating within the bores in response to movement of the swash-plate element, a cylinder head having a discharge chamber at the center thereof and a suction chamber at a peripheral region thereof and attached to the cylinder block at the other end thereof via a valve plate interposed therebetween, a pressure suppressing chamber communicating with the discharge chamber for receiving discharge gas from the discharge chamber, a partition wall extending a portion of the discharge chamber so as to partition the suction chamber, a discharge gas conducting passage provided in the cylinder head by the partition wall at a side of the valve plate for introducing the discharge gas into the pressure suppressing chamber from the discharge chamber, and a suction gas inlet passage provided in the cylinder head at a side away from the valve plate relative to the discharge gas conducting passage for introducing suction gas into the suction chamber from the exterior of the cylinder head such that the suction gas is divided to flow into the suction chamber at opposite outer sides of the partition wall defining the discharge gas conducting passage.

DESCRIPTION OF THE PREFERRED EMBODIMENTS

Figure 1:
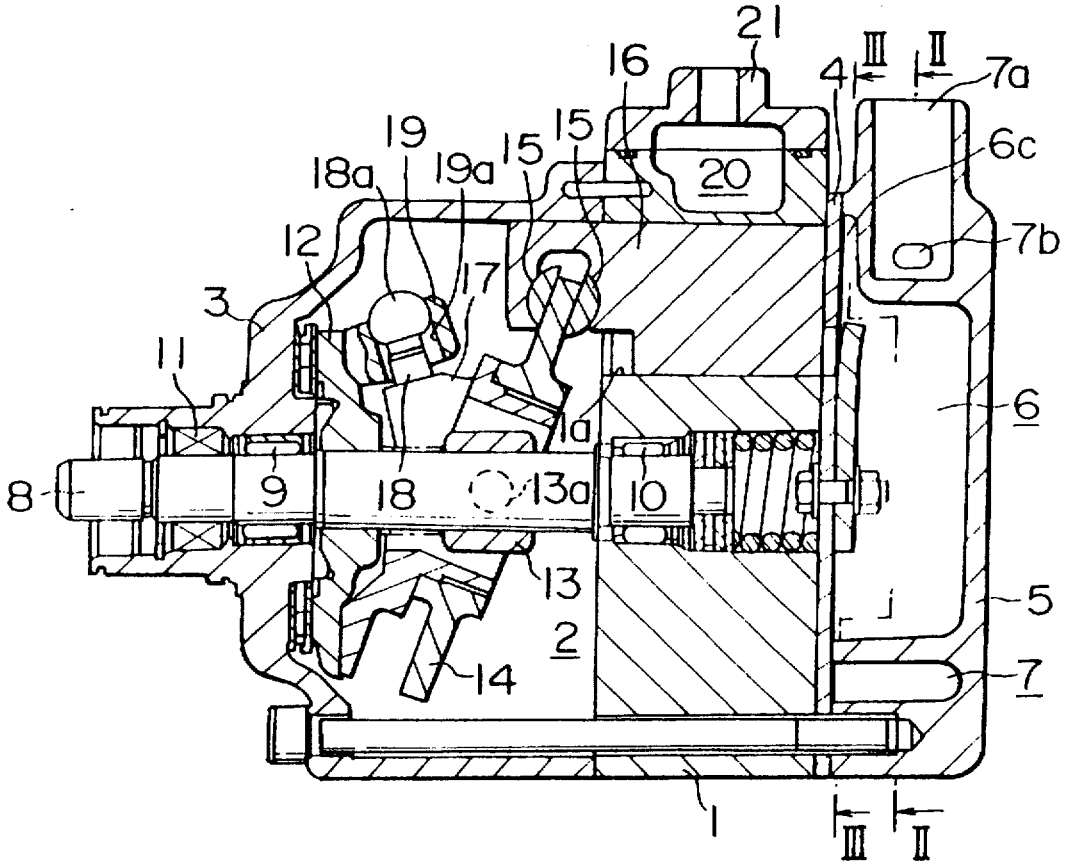
FIG. 1 is a longitudinal sectional view of a swash plate type compressor as a reciprocating compressor according to a first embodiment of the present invention.
Figure 2:
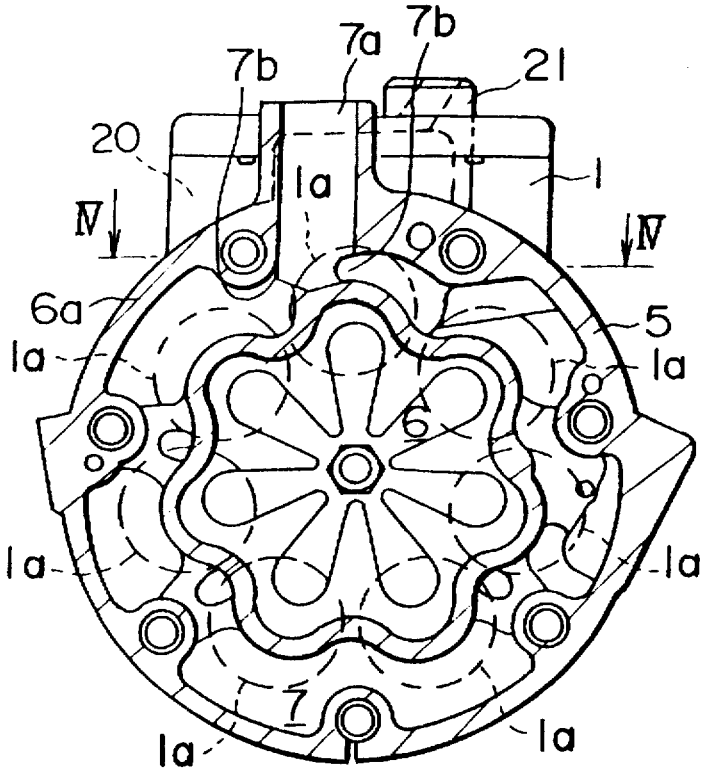
FIG. 2 is a sectional view taken along line II—II in FIG. 1.

Referring to FIGS. 1–4, description will be made as regards a swash plate type compressor as a reciprocating compressor according to a first embodiment of this invention. In the following description, the left side of FIG. 1 will represent the front side df the compressor while the right side thereof will represent the rear side of the compressor, which is only for the sake of convenience of description and is not intended to limit the invention in any way.

The swash plate type compressor is for use in a vehicle air conditioner and is generally called a single-head piston type. In the swash plate type compressor, a cylinder block 1 is formed therein with seven bores 1*a* arranged circumferentially in parallel to each other at regular intervals therebetween. A housing 3 includes therein a crank chamber 2 and closes the front end of the cylinder block 1. A cylinder head 5 is attached to the cylinder block 1 at the rear end thereof with a valve plate 4 interposed therebetween. The cylinder head 5 is formed therein with a discharge chamber 6 at the center thereof and a suction chamber 7 at the peripheral region thereof surrounding the discharge chamber 6 and extending parallel to on a plane the valve plate 4. The suction chamber 7 has a first and second opposite end which are adjacent and in opposition to each other to form a gap therebetween. Each of the bores la intermittently communicates with each of the discharge chamber 6 and the suction chamber 7 through the valve plate 4 in the manner known in the art.

A drive shaft 8 is supported by radial bearings 9 and 10 which are fixed to the housing 3 and the cylinder block 1, respectively. A shaft seal unit 11 is disposed in the housing 3 for sealing the drive shaft 8.

In the crank chamber 2, a rotor 12 is fixedly mounted on the drive shaft 8 so as to be rotatable with the drive shaft 8, while a sleeve 13 is loosely mounted on the drive shaft 8 so as to be slidable on the drive shaft 8. A pair of pivot pins 13*a* are fixed on the lateral sides of the sleeve 13 and received in corresponding engaging holes of a screw-assembled swash plate 14 so that the swash plate 14 is tiltably supported by the sleeve 13. A single-head piston 16 is slidably received in each of the bores 1*a*. Each piston 16 is formed with a pair of hemispherical concave portions facing each other and slidably receiving therein hemispherical shoes 15. Further, the swash plate 14 is slidably held between the shoes 15, and thus each piston 16 is coupled to the swash plate 14 through the hemispherical engagement between the shoes 15 and the corresponding concave portions of each piston 16. A combination of each bore 1*a* and each piston 16 inserted therein is referred to as a compression element.

On the front side of the swash plate 14, a pair of brackets 17 are fixedly mounted with a top dead center position of the swash plate 14 located therebetween. A guide pin 18 has a spherical head 18*a* and is fixed on each bracket 17. On the other hand, at the back of the rotor 12, a pair of support arms 19 are provided so as to receive the spherical heads 18*a* of the corresponding guide pins 18 in holes 19*a* formed through the corresponding support arms 19. Although the motion of the swash plate 14 is regulated by engagement between the spherical heads 18*a* of the guide pins 18 and the holes 19*a* of the support arms 19, the central inclination of each hole 19*a* is so set as to stably hold the top position of each piston 16. A combination of the rotor 12, the sleeve 13, and the swash plate 14 is operable as a swash-plate element. The brackets 17 and the support arms 19 form a hinge mechanism in cooperation with each other.

As described above, the discharge chamber 6 is disposed at the center of the cylinder head 5. As best seen from FIG. 3, the discharge chamber 6 communicates with a discharge gas conducting passage 6*c* defined by partition walls 6*a* and 6*b*. The partition walls 6*a* and 6*b* partition the suction chamber 7 and further extend out to the peripheral region of the cylinder head 5 beyond the peripheral region of the cylinder block 1 where the bore 1*a* is formed. On the other hand, an expansion pressure suppressing chamber 20 is formed at the outermost portion of the cylinder block 1. As seen from, FIGS. 1 and 3, an open end of the pressure suppressing chamber 20 is closed by a discharge flange 21.

The discharge gas conducting passage 6*c* is formed at the front side 6*a* and 6*b* of the partition walls 6*a* and 6*b* to pass through the gap between the first and second opposite ends of the suction chamber 7. Further, the discharge gas conducting passage 6*c* extends to turn outside and parallel to the suction chamber 7 to form a passage end communicating with the communication hole 22 through the valve plate 4. On the other hand, a suction gas inlet passage 7*a* is formed external to the partition walls 6*a* and 6*b*. In other words, the suction gas inlet passage 7*a* is adjacent to the discharge gas conducting passage 6*c* in a predetermined direction orthogonal to the plane of the valve plate 4. More particularly, the discharge gas conducting passage 6*c* extends between the suction gas inlet passage 7*a* and the valve plate 4. The suction gas inlet passage 7*a* is for introducing refrigerant gas as suction gas into the suction chamber 7 from the exterior of the cylinder head 5 and has two outlet ports or opened portions 7*b* which communicate with the first and second opposite ends of the suction chamber 7, respectively. Therefore, the suction gas is supplied into the suction chamber 7 through each of the opposite ends thereof.

Each of the outlet ports 7*b* has a diameter greater than a width of the discharge gas conducting passage 6*c* including thicknesses of the partition walls 6*a* and 6*b* (that is, a distance between opposite outer sides 6*a* and 6*b* of the partition wails 6*a* and 6*b* respectively defining therein the discharge gas conducting passage 6*c*) for allowing the suction gas to be divided or bifurcated to flow into the suction chamber 7 over the opposite outer sides 6*a*"and 6*b*"of the partition walls 6*a* and 6*b*.

When the compressor is activated, a rotary motion of the drive shaft 8 is transmitted to the swash plate 14 via the rotor 12 and the guide pins 18. Thus, each piston 16 reciprocates within the corresponding bore 1*a* so that the suction gas is introduced into the corresponding bore 1*a*, then compressed and discharged as discharge gas into the discharge chamber 6. Depending on a pressure differential between pressures in the crank chamber 2 and the suction chamber 7, the inclination of the swash plate 14 and thus the stroke of the pistons 16 are changed to control the capacity of the compressor in the manner known in the art. The pressure in the crank chamber 2 is controlled by a control valve mechanism (not shown) provided in the cylinder head 5 depending on the heat load.

The high-pressure discharge gas is discharged into the discharge chamber 6 from the respective bores 1*a* and is introduced into the pressure suppressing chamber 20 through the discharge gas conducting passage 6*c* and the communication hole 22. The pressure pulsation components of the discharge gas are attenuated by an expansion muffler function of the pressure suppressing chamber 20. Then, the discharged gas is delivered out to a connected cooling circuit (not shown) through a discharge port of the discharge flange 21.

On the other hand, the refrigerant gas is introduced as the suction gas into the suction chamber 7 through the suction gas inlet passage 7a from the exterior of the cylinder head 5. Upon introduction, the suction gas is bifurcated to flow into the suction chamber 7 via the outlet ports 7b.

Next referring to FIGS. 5–7, the description will be made as regards a swash plate type compressor as a reciprocating compressor according to a second embodiment of this invention. The swash plate type compressor comprises similar parts designated by like reference numerals.

Figure 3:
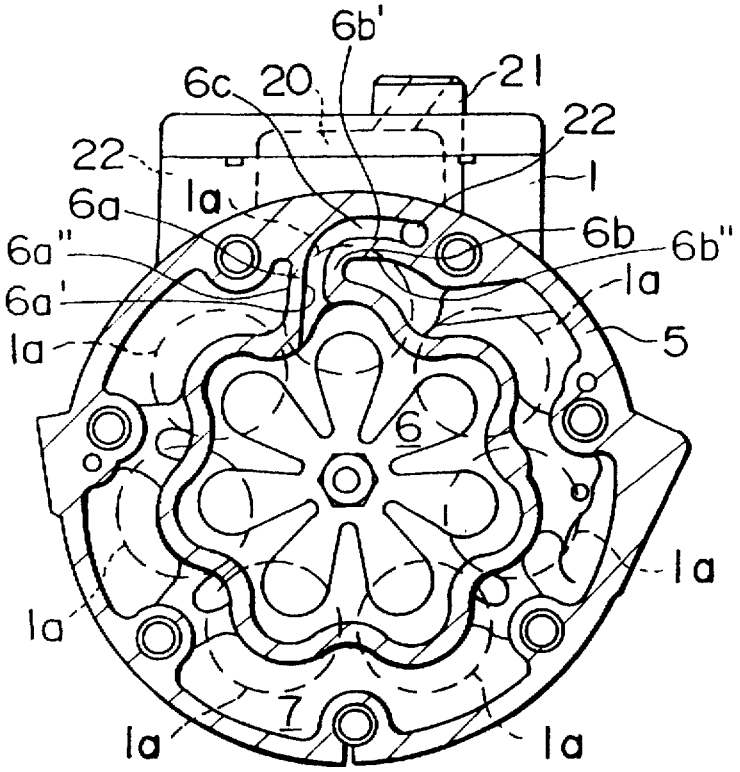
FIG. 3 is a sectional view taken along line III—III in FIG. 1.
Figure 4:
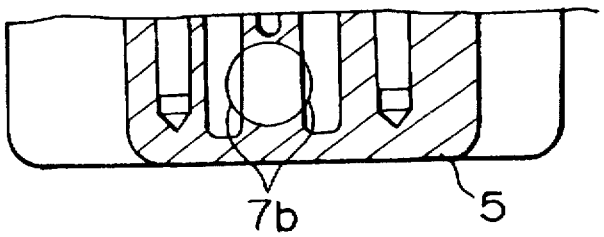
FIG. 4 is a sectional view taken along line IV—IV in FIG. 2.
Figure 5:
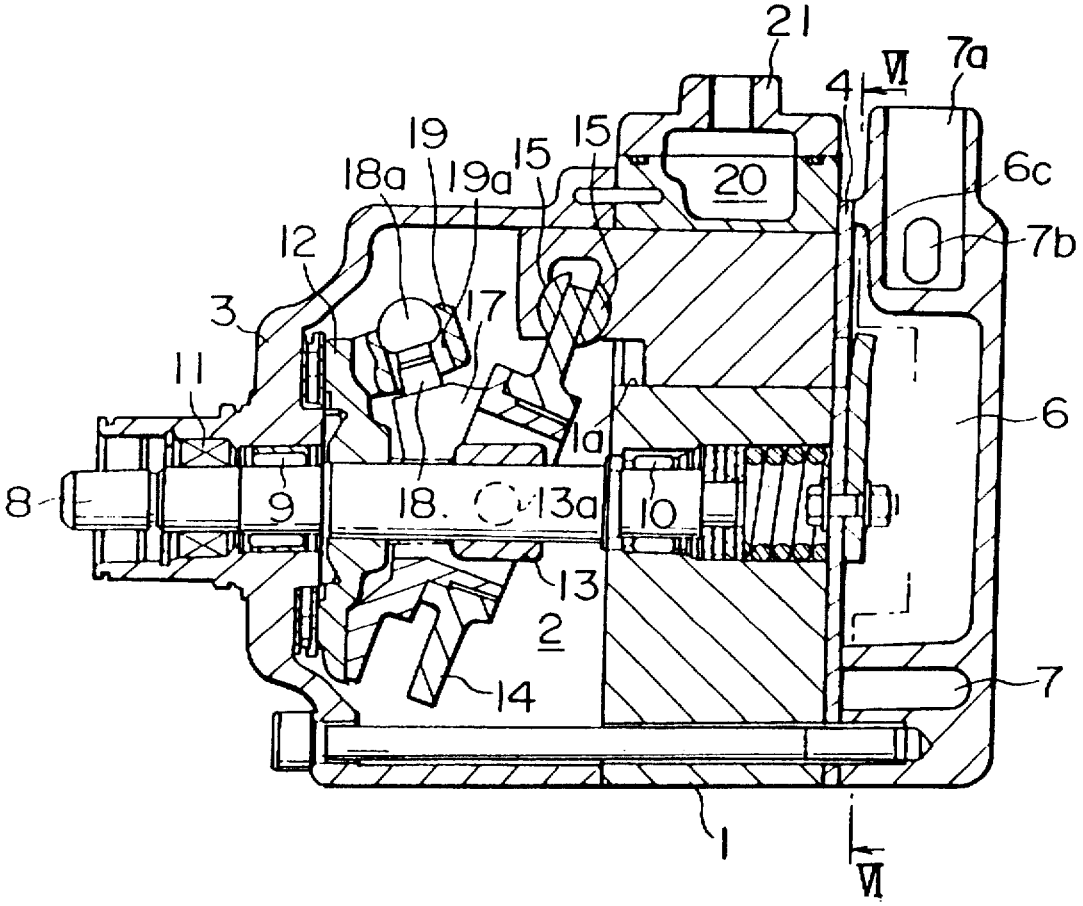
FIG. 5 is a longitudinal sectional view of a swash plate type compressor as a reciprocating compressor according to a second embodiment of the present invention.
Figure 6:
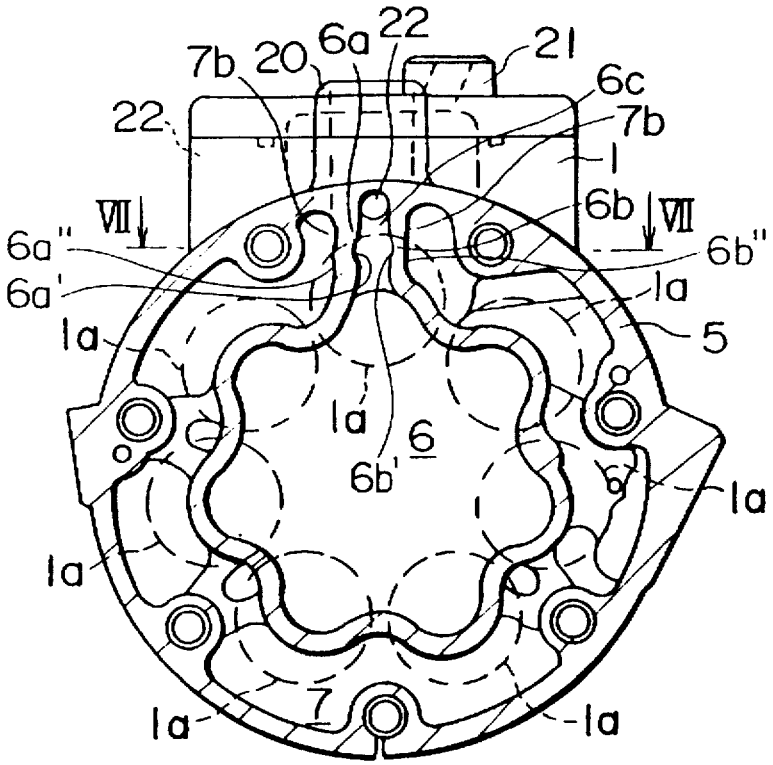
FIG. 6 is a sectional view taken along line VI—VI in FIG. 5.
Figure 7:
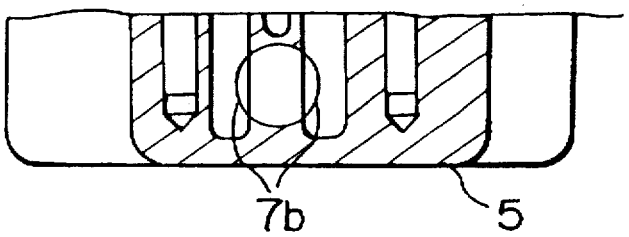
FIG. 7 is a sectional view taken along line VII—VII in FIG. 6.

As appreciated from comparison between FIGS. 3 and 6, the swash plate type compressor of FIGS. 5–7 differs from the swash plate type compressor of FIGS. 1–4 in the shape of the discharge gas conducting passage 6c defined by the partition walls 6a and 6b partitioning the suction chamber 7. Specifically, in the swash plate type compressor of FIGS. 1–4, the tip portion of the discharge gas conducting passage 6c is bent along the peripheral edge of the cylinder head 5 to extend toward the discharge flange 21. On the other hand, in the swash plate type compressor of FIGS. 5–7, the discharge gas conducting passage 6c extends linearly in the radial direction of the cylinder head 5.

As described above, the discharge gas conducting passage and the suction gas inlet passage are arranged adjacent to each other in the axial direction of the compressor. In addition, the suction gas is introduced through the suction gas inlet passage and is supplied into the suction chamber, surrounding the discharge chamber, at the opposite ends thereof. With this arrangement, the suction gas can be uniformly distributed into the respective bores without increasing the axial length of the compressor. Thus, the volumetric efficiency can be improved to increase the refrigerating capacity, and the generation of vibration and noise due to the suction pulsation can be prevented.

While the present invention has thus far been described in connection with a few embodiments thereof, it will readily be possible for those skilled in the art to put this invention into practice in various other manners. For example, although the description is made as regards the swash plate type compressor, this invention is applicable to another type compressor.

What is claimed is:

1. A reciprocating compressor comprising:

a cylinder block having a plurality of bores arranged in parallel;

a housing having therein a crank chamber and closing one end of said cylinder block;

a drive shaft rotatably supported by said cylinder block and said housing;

a swash-plate element mounted on said drive shaft;

pistons reciprocating within said bores in response to movement of said swash-plate element;

a cylinder head having a discharge chamber at the center thereof and a suction chamber at a peripheral region thereof and attached to said cylinder block at the other end thereof via a valve plate interposed therebetween;

a pressure suppressing chamber communicating with said discharge chamber for receiving discharge gas from said discharge chamber;

a partition wall extending from said discharge chamber so as to partition said suction chamber;

a discharge gas conducting passage provided in said cylinder head by said partition wall at a side of said valve plate for introducing the discharge gas into said pressure suppressing chamber from said discharge chamber; and a suction gas inlet passage provided in said cylinder head at a side away from said valise plate relative to said discharge gas conducting passage for introducing suction gas into said suction chamber from the exterior of said cylinder head such that the suction gas is divided to flow into suction chamber at opposite outer sides of said partition wall defining said discharge gas conducting passage.

2. The reciprocating compressor according to claim 1, wherein said discharge gas conducting passage and said suction gas inlet passage are adjacent and spaced from one another in an axial direction of said drive shaft.

3. The reciprocating compressor according to claim 1, wherein said discharge gas conduction passage has a bent shape including a portion which extends along a peripheral edge of said cylinder head, said portion communicating with said pressure suppressing chamber.

4. The reciprocating compressor according to claim 1, wherein said discharge gas conduction passage extends essentially linearly toward a peripheral edge of said cylinder head.

5. A reciprocating compressor comprising:

a discharge chamber extending on a plane;

a suction chamber extending around said discharge chamber on said plane to define a first and a second opposite end;

a suction gas inlet passage connecting said suction chamber for introducing gas into said suction chamber;

a plurality of compression elements arranged along said suction chamber and connected to said discharge chamber and said suction chamber, each of said compression elements having a piston which reciprocates to introduce the gas from said suction chamber, to compress the gas, and then to discharge the gas into said discharge chamber; and a discharge gas conducting passage connecting to said discharge chamber for conducting the gas from said discharge chamber;

said discharge gas conducting passage being adjacent in a predetermined direction orthogonal to said plane to said suction gas inlet passage in a predetermined direction orthogonal to said plane, said suction gas inlet passage communicating with each of said opposite ends of the suction chamber so that the gas is supplied into said suction chamber through each of said opposite ends thereof.

6. A reciprocating compressor as claimed in claim 5, further comprising a pressure suppressing chamber connected to said discharge gas conducting passage for receiving discharge gas from said discharge chamber.

7. A reciprocating compressor as claimed in claim 6, further comprising a valve plate placed between said discharge gas conducting passage and said pressure suppressing chamber to define a communication hole communicating said discharge gas conducting passage with said pressure suppressing chamber.

8. A reciprocating compressor as claimed in claim 7, wherein said discharge gas conducting passage extends between said suction gas inlet passage and said valve plate.

9. A reciprocating compressor as claimed in claim 8, wherein said opposite ends of the suction chamber are opposite to each other to have an interval left therebetween, said discharge gas conducting passage passing through said interval and having a passage end communicating with said communication hole.

10. A reciprocating compressor as claimed in claim 9, wherein said discharge gas conducting passage extends outside said suction chamber along said plane.

* * * * *

UNITED STATES PATENT AND TRADEMARK OFFICE

CERTIFICATE OF CORRECTION

PATENT NO. : 5,782,614

DATED : July 21, 1998

INVENTOR(S) : Shigemi SHIMIZU and Yujiro MORITA

It is certified that error appears in the above-indentified patent and that said Letters Patent is hereby corrected as shown below:

Title page, item [56], Foreign Patent Documents, insert:

--61-145,884 9/1986 Japan 07-139,463 5/1995 Japan

Signed and Sealed this

Twenty-seventh Day of October, 1998

*Attest:*

Bruce Lehman

BRUCE LEHMAN

*Attesting Officer*

*Commissioner of Patents and Trademarks*